US007944280B2

(12) United States Patent
Gabillard et al.

(10) Patent No.: US 7,944,280 B2
(45) Date of Patent: May 17, 2011

(54) BANDGAP REFERENCE GENERATOR UTILIZING A CURRENT TRIMMING CIRCUIT

(75) Inventors: Bertrand Gabillard, Paris (FR); Philippe Girard, Le Coudray-Montceaux (FR); Michel Rivier, Barbizon (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/198,183

(22) Filed: Aug. 26, 2008

(65) Prior Publication Data

US 2009/0289697 A1 Nov. 26, 2009

(30) Foreign Application Priority Data

May 26, 2008 (EP) ..... 08305199

(51) Int. Cl.
*G05F 1/10* (2006.01)
*G05F 3/02* (2006.01)

(52) U.S. Cl. ..... 327/538; 323/282

(58) Field of Classification Search ..... 327/538, 327/539–541, 543; 323/282, 284
See application file for complete search history.

(56) References Cited

U.S. PATENT DOCUMENTS

| | | | | |
|---|---|---|---|---|
| 4,713,599 | A | 12/1987 | Davis | |
| 5,231,316 | A | 7/1993 | Thelen, Jr. | |
| 5,353,028 | A | 10/1994 | de Wit et al. | |
| 5,757,264 | A | 5/1998 | Petit | |
| 6,841,982 | B2 | 1/2005 | Tran | |
| 6,911,861 | B2 | 6/2005 | Deng | |
| 7,019,581 | B1 | 3/2006 | Potanin et al. | |
| 7,427,892 | B2 * | 9/2008 | Fujikura et al. | 327/540 |
| 2006/0056485 | A1 | 3/2006 | Hartley | |

* cited by examiner

*Primary Examiner* — Lincoln Donovan
*Assistant Examiner* — Diana J Cheng
(74) *Attorney, Agent, or Firm* — Cantor Colburn LLP; Wenjie Li

(57) ABSTRACT

A circuit for providing a bandgap voltage. The circuit includes a classic bandgap reference voltage generation circuit including first end second serially connected transistors acting as a current mirror to another portion of the classical bandgap reference circuit and being coupled between a supply voltage $V_{dd}$ and an output resistor. The circuit also includes a current trimming circuit coupled in parallel with the classical bandgap reference generation circuit including a fixed element portion including a plurality of transistors and a switch portion including a plurality of switches. Each of the plurality of transistors is coupled to the supply voltage $V_{dd}$ and to a one of the plurality of switches and each switch includes a fuse.

13 Claims, 5 Drawing Sheets

BANDGAP REFERENCE GENERATOR UTILIZING A CURRENT TRIMMING CIRCUIT

This application claims priority to European Patent Application No. 08305199.5, filed 26 May 2008, and all the benefits accruing there from under 35 U.S.C. §119, the contents of which in its entirety are herein incorporated by reference.

BACKGROUND OF THE INVENTION

1. Field of the Invention

The present invention is directed to integrated circuits and, in particular, to generating a bandgap voltage.

2. Related Art

Most of the state of the art chips use dedicated circuits that regulate the voltage of the core circuitry. In many instances, these dedicated circuits are designed to create a reference voltage with high precision. The overall objective of designing a precision reference is to achieve high accuracy over all working conditions. These circuits should be made insensitive to external power supply variation, to temperature variation and to process variations. These circuits are designed utilizing bandgap voltage references.

The operation principle of bandgap voltage references is straightforward. The voltage difference between two diodes, often operated at the same current and of different junction areas, is used to generate a proportional to absolute temperature (PTAT) current ($I_{ptat}$) in a first resistor. This current is used to generate a voltage across a second resistor. This voltage in turn is added to the voltage of one of the diodes (or a third one, in some implementations). The voltage across a diode operated at constant current, or here with a PTAT current, is complementary to absolute temperature (CTAT—reduces with increasing temperature), with approximately −2 mV/K. If the ratio between the first and second resistor is chosen properly, the first order effects of the temperature dependency of the diode and the PTAT current will cancel out. The resulting voltage is about 1.2-1.3 V, depending on the particular technology, and is close to the theoretical bandgap of silicon at 0 K. The remaining voltage change over the operating temperature of typical integrated circuits is on the order of a few millivolts. This temperature dependency has a typical parabolic behavior.

Because the output voltage is by definition fixed around 1.25 V for typical bandgap reference circuits, the minimum operating voltage is about 1.4 V, as in a CMOS circuit at least one drain-source voltage of a FET (field effect transistor) has to be added. Therefore, recent work concentrates on finding alternative solutions, in which for example currents are summed instead of voltages, resulting in a lower theoretical limit for the operating voltage.

FIG. 1 shows an example of circuit 100 that generates a bandgap reference voltage. The circuit 100 produces a current PTAT current $I_{ptat}$. Due to the current mirror formed by FETs P3 and P4, the current $I_{out}$ is roughly equal to $I_{ptat}$. Of course, by varying the width of P3 and P4 relative to P2, the relationship between $I_{out}$ and $I_{ptat}$ may be varied. The current $I_{out}$ develops a voltage, equal to $I_{out}R_2$ which, when added to the voltage drop across diode D3, provides an output reference voltage $V_{ref}$ with nominally zero temperature coefficient. The reference voltage $V_{ref}$ equals:

$$V_{ref}=V_{D3}+I_{out}R_2$$

Utilizing well known relationships, $I_{out}$ may be represented as:

$$I_{out}=(V_t n.\ln(r))/R1$$

where $V_t$=KT/Q n=pn-junction diode ideality coefficient r=area ratio (A2/A1) between diode $D_2$ and $D_1$, resulting in $V_{ref}=V_{D3}+R_2(V_t.n.\ln(r))/R_1)$ The supply voltage variations have low impact on bandgap voltage deviation as long as the two voltages $V_{s1}$ and $V_{s2}$ are equal, which is insured if cascoded current mirror or operational amplifier techniques are used.

$I_{ptat}$ cancels only the first-order term in the polynomial approximation that represents relationship between the diode voltage and temperature. Thus, the $V_{ref}$(Temp) curve exhibits a negative parabolic shape. By adjusting circuit elements R1, R2, and r, the value of the temperature coefficient (TC) at a given temperature (usually room temperature) can be set to zero.

The process sensitivity of is mainly due to the mismatch of the diodes $D_1$-$D_3$, that have different values depending on the position on the chip or from chip to chip, across a wafer. Several approaches have been used to minimize the impact of process variations on these type of circuits, all of those are associated to achieving the desired value of the $V_{ref}$ by tuning the value of the resistor $R_2$ For example, a laser trimming technique may be used to achieve the desired value of the resistor $R_2$. Depending on the methods used to trim, thin-film resistors can be trimmed to ±0.1 percent of value and thick-film resistors to ±1.0 percent. Unfortunately the process is slow, and this approach remains expensive.

Another approach has been link fuse trimming in which $R_2$ is split into 2 series resistors, $R_2'$ and $R_2''$. Link fusing trimming is a process of selecting a desired resistance from a series of geometrically increasing resistors which comprise $R_2''$ fused together by thin jumper wires. Connected to each end of a fuse are two probe pads. Through these probe pads, a current is applied to selected fuses and in doing so, blows open the fuse. In this approach, the resistor $R_2$ is typically equal to 10K and could be trimmed by ±3%. Therefore, the resistor $R_2'$ may consist of a fixed resistor of 9.7K in series with 5 geometrically increasing resistors ($R_2''$) whose the total resistance is 600 ohm. The unit resistance being 20 ohm, to short circuit this resistor the un-blown fuse must have a resistance lower than 2 ohm, which is not realistic. Furthermore, accuracy concerns arise using this method.

Another approach is the so called "Zener zapping" technique, which consists of using a set of Zener diodes in parallel with a set of series connected resistors. An unwanted resistor is short circuited by blowing the Zener diode. However, precision accuracy poses a problem when using zener diode sets.

In short, each approach to making the typical PTAT current generator circuit shown in FIG. 1 impervious to process variations has significant drawbacks. What is needed, then, is an approach that achieves the goal of the above-described circuits without the same shortcomings.

BRIEF SUMMARY OF THE INVENTION

An exemplary embodiment includes a circuit for providing a bandgap voltage. The circuit of this embodiment includes a classic bandgap reference voltage generation circuit including first end second serially connected transistors acting as a current mirror to another portion of the classical bandgap reference circuit and being coupled between a supply voltage Vdd and an output resistor. The circuit of this embodiment also includes a current trimming circuit coupled in parallel with the classical bandgap reference generation circuit including a fixed element portion including a plurality of transistors and a switch portion including a plurality of switches. In this embodiment, each of the plurality of transistors is coupled to the supply voltage Vdd and to a one of the plurality of switches and each switch includes a fuse.

Another embodiment of the present invention is directed to a method of adjusting an output reference voltage. The method of this embodiment includes coupling a current trimmer to a conventional bandgap voltage reference generator, the current trimmer including one or more current mirrors; applying a first configuration of the current mirrors in the current trimmer; measuring a first reference voltage produced by the conventional bandgap reference voltage generator; applying a second configuration of current mirrors to in the current trimmer; measuring a second reference voltage produced by the conventional bandgap reference voltage generator; determining whether the first reference voltage or the second reference voltage is closer to a desired reference voltage; and applying the first configuration when the first reference voltage is closer to the desired reference voltage or applying the second configuration when the second reference voltage is closer to the desired reference voltage.

BRIEF DESCRIPTION OF THE DRAWINGS

Referring now to the drawings wherein like elements are numbered alike in the several FIGURES.

DETAILED DESCRIPTION OF EXEMPLARY EMBODIMENTS

Figure 1:
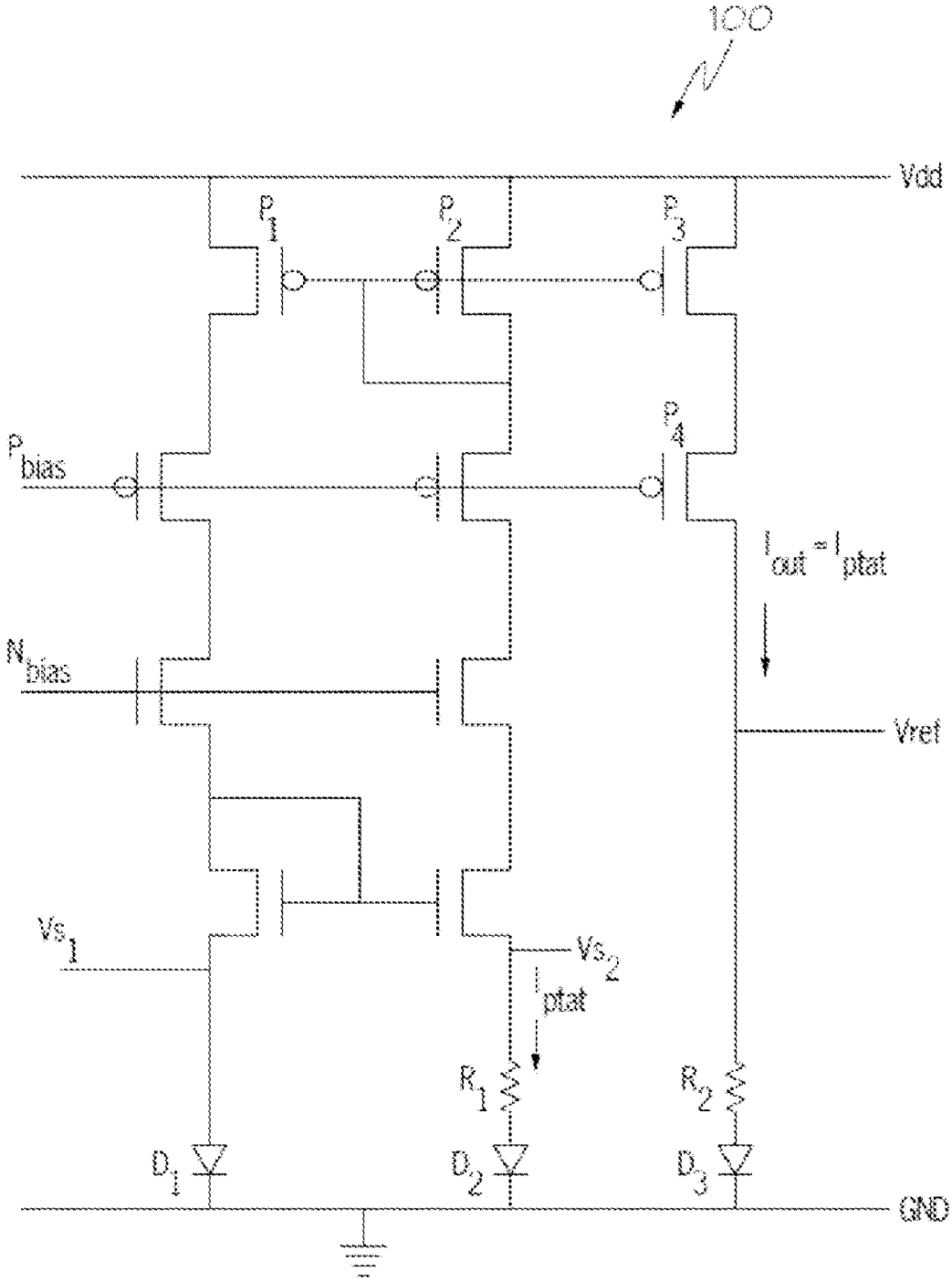
FIG. 1 Prior Art
FIG. 1 depicts an example of a prior art bandgap reference voltage generation circuit.

An exemplary embodiment of the present invention provides a circuit where the $I_{out}$ current flowing into a resistor $R_2$ in a classic bandgap reference generation circuit (shown in FIG. 1) is adjusted, or "trimmed," by utilizing fuses rather than the prior art method of trimming $R_2$ (or $R_1$). Operating in such a manner may help to provide a process variation insensitive reference voltage $V_{ref}$.

In particular, embodiments of the present invention may include a classic bandgap reference voltage circuit having a current trimming circuit coupled thereto in such a manner that $I_{out}$ is adjusted to maintain a process variation insensitive bandgap reference voltage. The current trimming circuit includes a plurality of current mirrors that may be switched in or out by blowing fuses coupled to one of the transistors that form the current mirror. That is, blowing a fuse will either enable or disable a portion of the current trimming circuit. As such, unlike the prior art, the fuses act as digital elements rather than analog elements. In one embodiment, a microcontroller may be configured to determine which fuses to blow to achieve the desired $V_{ref}$ before the fuses are blown.

Figure 2:
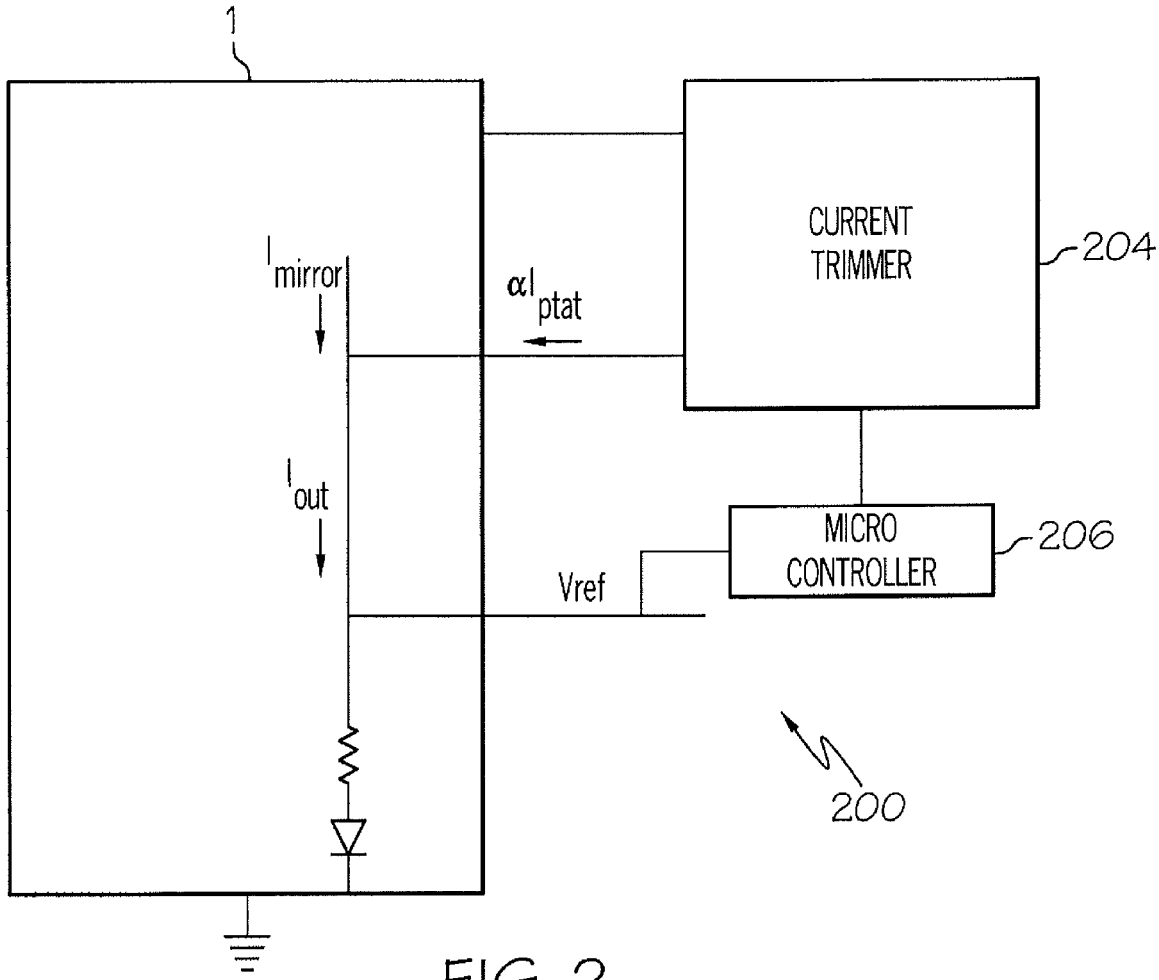
FIG. 2 depicts an example of a high-level block diagram of a circuit according to one embodiment of the present invention.

FIG. 2 shows an example of a circuit 200 according to one embodiment of the present invention. The circuit includes classical bandgap reference voltage generation circuit 100. As discussed above, the circuit 100 produces a bandgap reference voltage $V_{ref}$. $V_{ref}$ as shown, is equal to the product of the current $I_{out}$ times the value of $R_2$ plus the voltage drop across the diode $D_3$. With respect to the classical bandgap reference voltage generation circuit 100, for ease of explanation only elements $R_2$ and $D_3$ will be discussed herein.

It has been discovered that the bandgap voltage $V_{ref}$ is temperature dependant for a classical bandgap reference voltage generation circuit 100 in isolation. Typically, the voltage deviation is about 5 mV over a −50 to 125 degrees C. range. As discussed above, in the prior art there are several approaches to compensate for this effect. All of these approaches deal with adjusting the value of $R_2$. It has also been discovered that process variations in the formation of the classical bandgap reference generation circuit 100 may generate a current $I_{mirror}$ that creates a reference voltage $V_{ref}$ that is not at the precise level desired. Aspects of the present invention may add or subtract from $I_{out}$ a portion of $I_{ptat}$ (referred to as $\alpha I_{ptat}$ herein). As such, for the following discussion, $I_{out}=I_{mirror}+\alpha I_{ptat}$.

According to an embodiment of the present invention, the circuit 200 may include a current trimmer 204 coupled to the bandgap circuit 100. The current trimmer 204 is coupled to the bandgap reference voltage circuit 100 and functions to adjust the current $I_{out}$ to keep $V_{ref}$ at a desired value. In one embodiment, the current trimmer 204 may be implemented as a programmable series of cascode current mirror PFETs.

The circuit 200 may also include microcontroller 206 coupled to both the bandgap circuit 100 and the current trimmer 204. The microcontroller 206 controls the operation and configuration of the current trimmer 204, based on an observed value of $V_{ref}$, to adjust $I_{out}$. In one embodiment, the microcontroller 206 causes switches in the current trimmer 204 to open or close to increase or decrease the value of $I_{out}$ in order to set $V_{ref}$ at a desired value. In one embodiment, the switches may add or exclude a PFET from the current trimmer and thereby add or exclude a current mirror from the circuit 200. Such additions may allow, for example, $I_{out}$ to be increased or decreased from a center value by a small amount (in the range of 4% in either direction).

Figure 3:
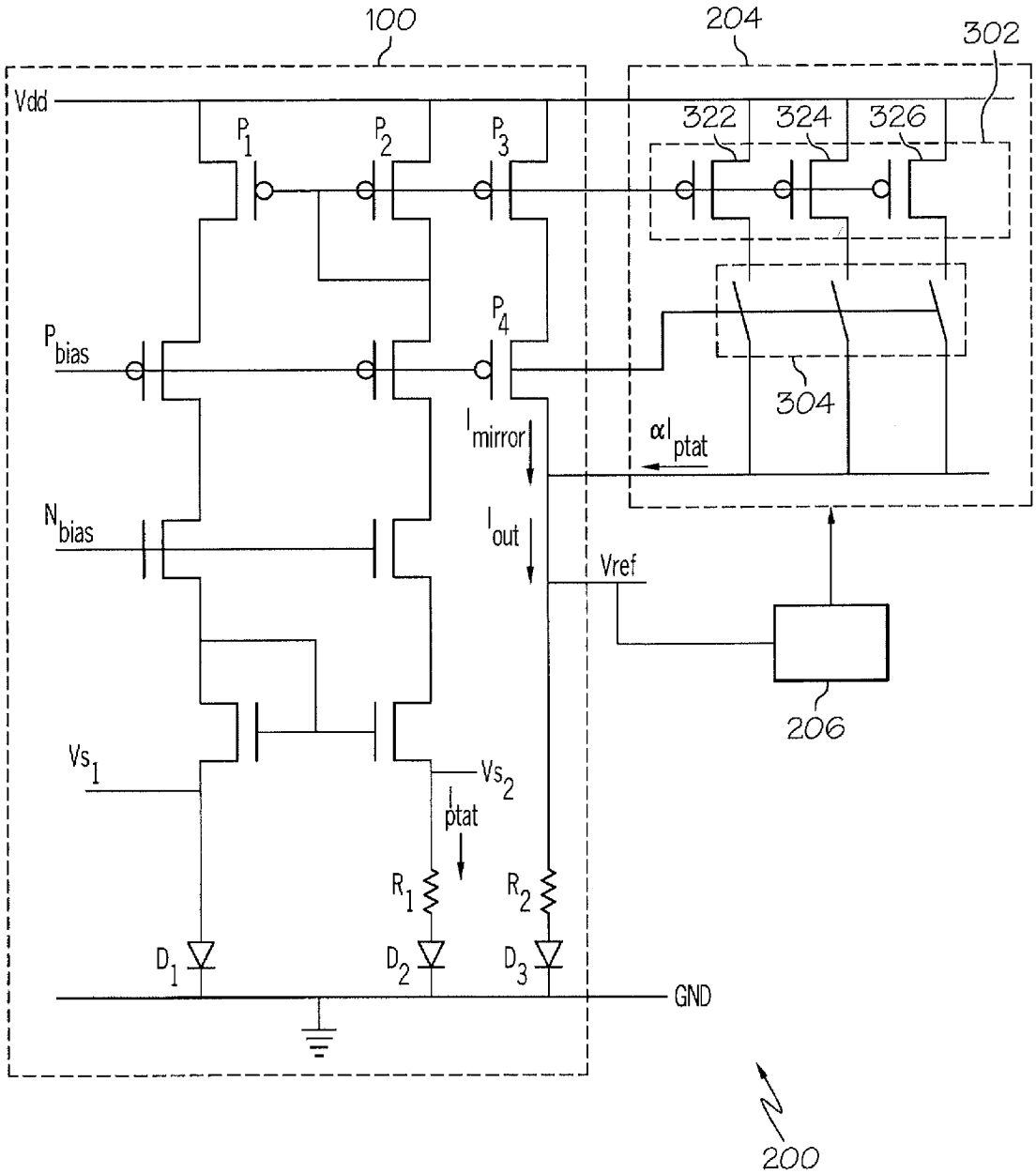
FIG. 3 depicts a more detailed version of the circuit shown in FIG. 2.

FIG. 3 shows a more detailed version of the circuit 200 shown in FIG. 2. The circuit 200 includes, as before, the classic bandgap reference voltage generator 100 coupled to the current trimmer 204. The circuit 200 also includes a microcontroller 206 coupled to both the bandgap circuit 100 and the current trimmer 204.

The current trimmer 204 includes, in one embodiment, a fixed element portion 302 which may be coupled to $V_{ref}$ through a switch portion 304. In one embodiment, the fixed element portion 302 includes a plurality of transistors. For example, the fixed element portion may include a first transistor 322, a second transistor 324, and a third transistor 326. Of course, the number or transistors is not limited to three and the fixed element portion 302 could include as few as one transistor or any number greater than one transistor depending on the application. In one embodiment, the fixed element portion 302 may include five transistors. In one embodiment, the transistors in the fixed element portion 302 may be PFET's, each of which has is its source coupled to $V_{dd}$.

The drain of each of the transistors in the fixed element portion 302 is coupled to $V_{ref}$ through one of the switches in the switch portion 304. In one embodiment, each switch is implemented as a collection of transistors and a fuse that, utilizing conventional methods, may be blown. The blowing one of the fuses may either add or remove (depending on whether the switch is a normally open or a normally closed switch) a current mirror, formed by the transistors in the switch and the transistor in the fixed element portion 302 to which the switch is attached, from the current trimmer 204.

As discussed above, the current $I_{ptat}$ flowing through $D_2$ is, in a classic bandgap reference circuit, duplicated to flow into resistor $R_2$ by forming a current mirror comprised of P3 and P4. As one of skill in the art will realize, the current flowing out of the current mirror, $I_{mirror}$, may not be exactly the same as $I_{ptat}$. Indeed, $I_{mirror}=I_{ptat}$ times the ratio of the width of the $P_3$ to $P_2$. According to the present invention, a small fraction of the of the $I_{ptat}$ current is added into the current flowing through $R_2$ to compensate the diode voltage deviations due to process and temperature variations. This may be accomplished by adding additional current mirrors to the bandgap circuit 100 in the current trimmer 204. In the circuit of FIG. 3, the bandgap voltage $V_{ref}$ can be written:

$$V_{ref}=R_2/R_1.V_r.n.\mathrm{LN}(r)+V_{d3}+\Delta V_{d3}+\alpha R2/R1.Vt.n.\mathrm{LN}(r)$$

which may be approximated by the relation:

$$V_{ref}\sim V_{d3}+R_2(I_{mirror}+\alpha I_{ptat})$$

The coefficient $\alpha$ is obtained by using set of parallel connected current mirrors that as describe above. In one embodiment, the value of $\alpha$ is controlled by the width of the transistors (typically implemented as PFET's) forming the current mirror as is well know in the art. That is, the width of the PFETs determines the current that flows through each current mirror. In one embodiment, each current mirror (defined as combination of transistor from the fixed element portion 302 and a transistor from the switch section 304) includes PFETs having a width W. Each successive current mirror includes, in one embodiment, transistors having a width 2 times that of the a previous mirror. For instance, if a first current mirror includes PFETs having a width W, the width of the PFETs in the second mirror is 2 W, the width of the PFETs in the third mirror is 4 W and so one. As is well know in the art, each current mirror duplicates the current $I_{ptat}$ according to their W/L ratio versus the W/L ratio of PFET P2. As such, each current mirror may, in some embodiments, generate a current that is a fraction of $I_{ptat}$ which, when summed, creates the current $\alpha I_{ptat}$. Various switch configurations will yield different currents. The precise configuration of the switches may be determined by the microprocessor 206 as discussed in greater detail below.

In one embodiment, the switches may include a PFET whose the gate is supplied to voltage $P_{bias}$ through a pass gate (either an NFET or a PFET). This pass gate is on or off depending on the switch or fuse status (blown or closed). The switch coupled to a transistor 322 is designed to be closed when its fuse is not blown (normally closed switch), while the remaining switches are designed to be open when their fuses are not blown.

In one embodiment, for example, the current flowing out of the drain of P4, $I_{mirror}$, may be represented as x % of $I_{ptat}$ (based on the ratio of the width of P3 to the width of P2 and the total current flowing out of the current trimmer 204 may be represented as (100−x) % of $I_{ptat}$ where $100-x=\alpha$. In such a case, in a typical operating environment, x may equal 96. Thus, the current $I_{out}$ may vary by up to 8%, from 92% $I_{ptat}$ to $I_{ptat}$.

Figure 4A:
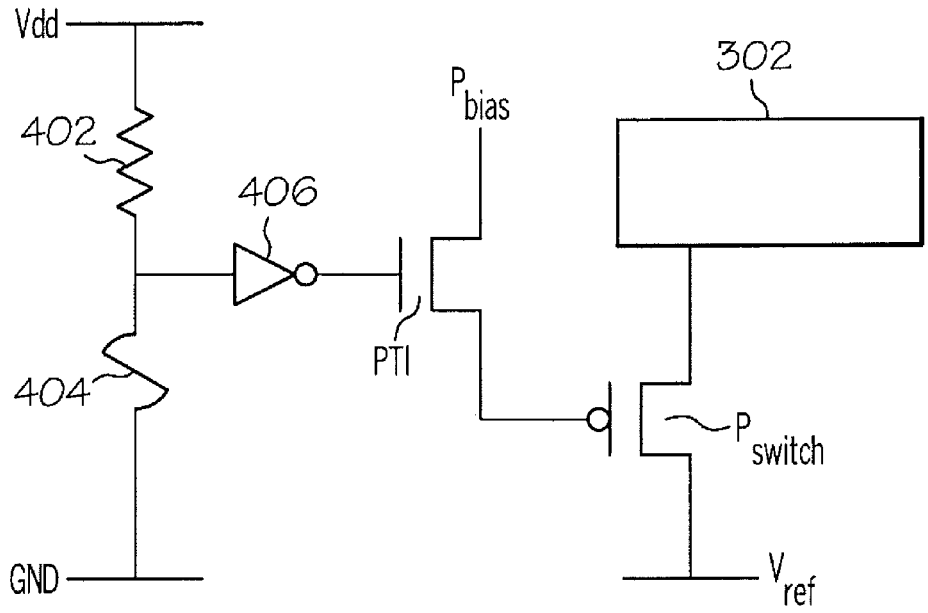
FIGS. 4A and 4B depict examples of switches that may be included in a trimming circuit according embodiments of the present invention.

FIG. 4A shows an example of a switch element 400 that may be connected to the transistor 322 of FIG. 3. As discussed above, this switch element may be implemented as a normally closed switch. The purpose of the switch element 400 is to either enable or disable the PFET $P_{switch}$. When $P_{switch}$ is enabled, transistor 322 and $P_{switch}$ act as a current mirror in that same manner as P3 and P4 shown in FIG. 3.

In more detail, switch element 400 may include a first resistor 402 coupled to $V_{dd}$ and one terminal of a fuse 404. The other terminal of the fuse 404 is coupled to ground. An inverter 406 has its input coupled between the first resistor 402 and the fuse 404 and its output coupled to the gate of the pass transistor PT1. The source of pass transistor PT1 is coupled to $P_{bias}$ and the drain of pass transistor PT1 is coupled to the gate of $P_{switch}$. In this example, $P_{switch}$ and PT1 are both implemented as PFET's. Of course, depending on the application, other types of transistors may be used for either or both $P_{switch}$ or PT1. Regardless of implementation, when the fuse 404 is closed, $P_{switch}$ is coupled to transistor 322. In short, when the fuse 404 is blown, the switch element 400 is open.

Figure 4B:
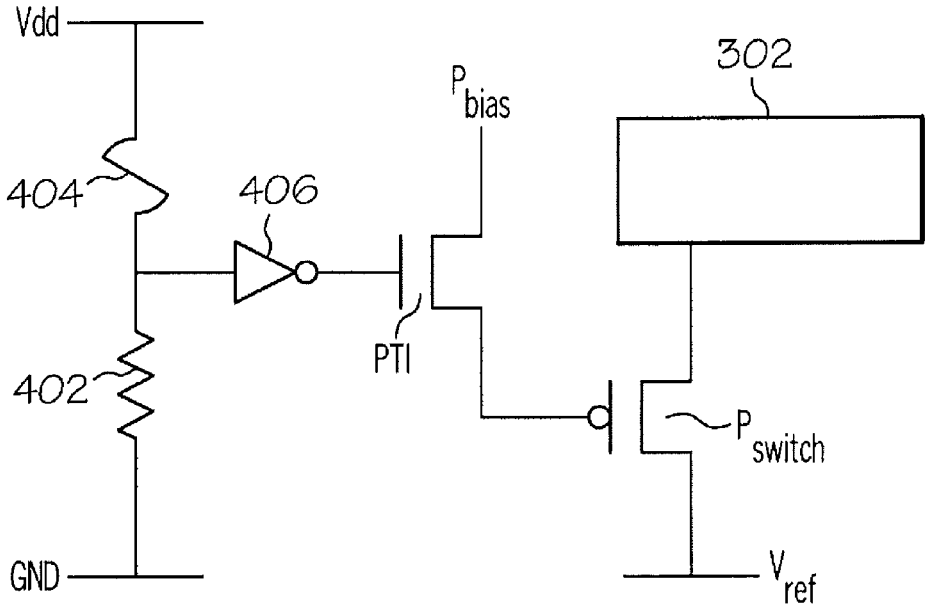

FIG. 4B shows an example of a normally open switch element 410. Such a normally closed switch 410 may be coupled, for example, to transistors 324 and 326 (FIG. 3). The only difference between the switch element 400 and the normally closed switch element 410 is that the resistor 402 is coupled to ground and the fuse 404 is coupled to $V_{dd}$. When the fuse 404 is blown, the normally open switch is closed thus coupling, through $P_{switch}$, the fixed element to which it is attached to $V_{ref}$.

Figure 5:
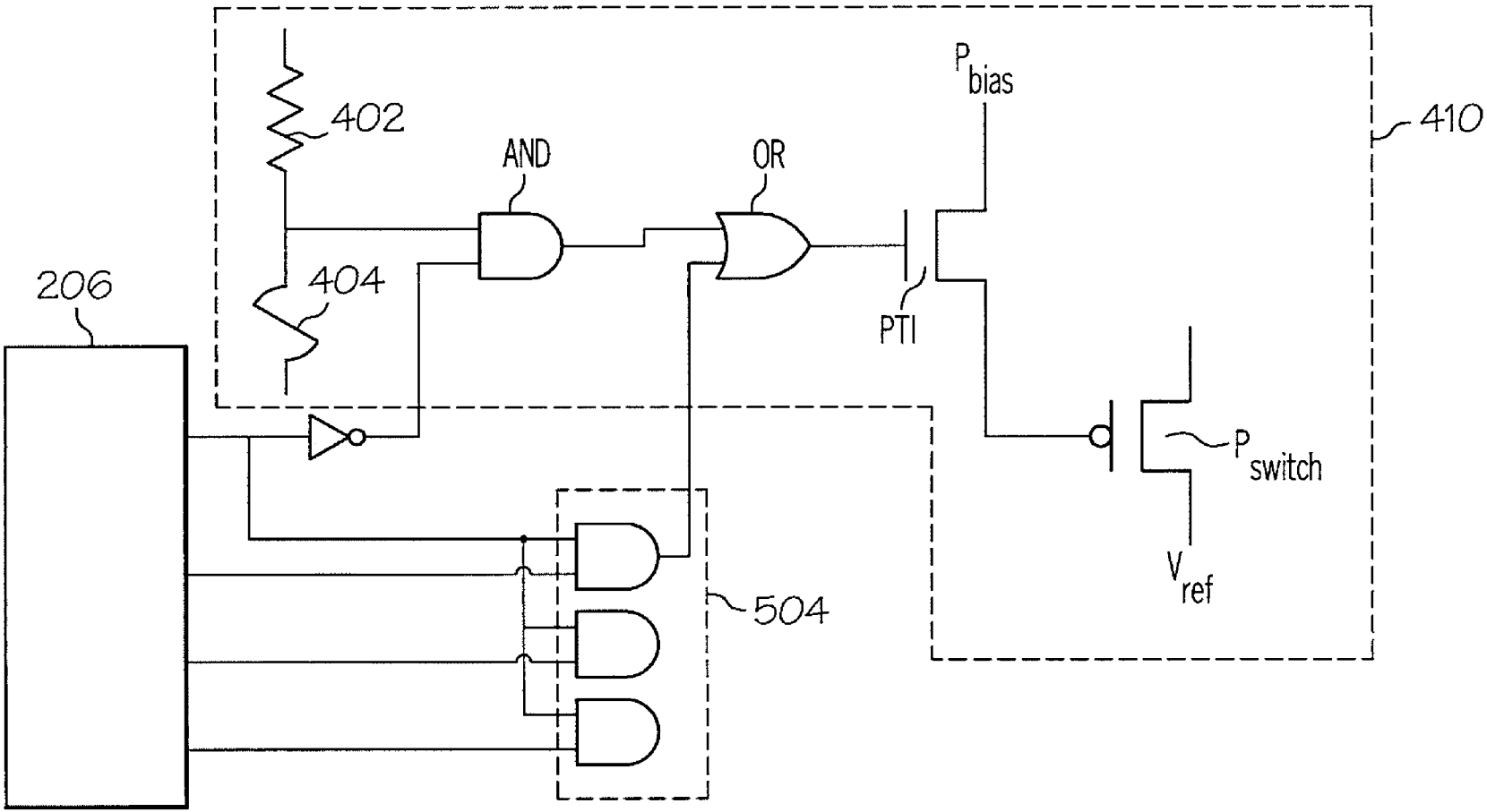
FIG. 5 depicts an example of a testing circuit between the microcontroller and the switches of the trimming circuit to determine the proper switches to open and close according to an embodiment of the present invention.

FIG. 5 shows an example of an implementation of the microcontroller 206 configured to find the best fuse combination before any of the fuses are blown. One of skill in art will understand that the microcontroller may also be coupled to the trimming circuit 204 such that it may control and effectuate the blowing of fuses.

The implementation shown includes a normally open switch 502 that is similar to the switch shown in FIG. 4A but having an and gate AND1 and an or gate OR coupled between the inverter 406 and the gate of the pass transistor PT1. The output of the inverter 406 is coupled to one input of AND1. The other input to AND1 is coupled to an inverted enable output of the microcontroller 206. The enable signal is also coupled to one input of each of plurality of bit enable and gates 504. Bit select lines are each coupled to another of the inputs of the bit enable and gates 504. As one of ordinary skill in the art will realize, such a configuration allows for any combination of switches coupled to the microcontroller 502 to be activated individually or in combination.

In one embodiment, the microcontroller 206 may activate various combinations of switches to determine which combination produces a $V_{ref}$ that is closest to the desired value. Of course, the microcontroller 206 may include means for measuring the value of $V_{ref}$ and comparing it to a predetermined value. In one embodiment, the microcontroller 206 may apply a dichromatic search algorithm to determine the best combination of fuses to be blown. After the combination has been detected, the fuses may be blown.

As described above, the embodiments of the invention may be embodied in the form of computer-implemented processes and apparatuses for practicing those processes. Embodiments of the invention may also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a generalpurpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A circuit for providing a bandgap voltage comprising:

a classic bandgap reference voltage generation circuit, the classic bandgap reference generation circuit including first end second serially connected transistors acting as a current mirror to another portion of the classical bandgap reference circuit and being coupled between a supply voltage $V_{dd}$ and an output resistor; and a current trimming circuit coupled in parallel with the classical bandgap reference generation circuit, the current trimming circuit including a fixed element portion including a plurality of transistors and a switch portion including a plurality of switches, wherein in each of the plurality of transistors is coupled to the supply voltage $V_{dd}$ and to a one of the plurality of switches and wherein each switch includes a fuse, wherein the plurality of switches includes a first switch, a second switch and a third switch and wherein the first switch is a normally closed switch, the second switch is a normally open switch and the third switch is a normally open switch, and wherein each switch includes:

a resistor having a first end and a second end, the second end connected to ground;

a fuse having a first and second end, wherein the first end of the fuse is coupled to the first end of the resistor;

an inverter having an input and an output, wherein the input is coupled to the first end of the resistor;

a pass transistor having a gate and a drain, wherein the gate is coupled to the first end of the resistor;

a switch transistor having a gate, a drain, and a source, wherein the gate is couple to the drain of the pass transistor, the source is couples to one of the plurality of transistors, and the drain is coupled to the output resistor;

wherein the plurality of transistors includes a first transistor, a second transistor and a third transistor, wherein a width of the first transistor is less than a width of the second transistor and the width of the second transistor is less than a width of the third switch transistor.

2. The circuit of claim 1, wherein the pass transistor is an NFET.

3. The circuit of claim 1, wherein the switch transistor is a PFET.

4. The circuit of claim 1, further comprising a microcontroller coupled to the classic bandgap reference circuit and the current trimming circuit.

5. The circuit of claim 4, wherein the microcontroller is configured to determine a combination of fuses to blow to match an output voltage produced by the classic bandgap reference generation circuit to a predetermined value.

6. The circuit of claim 5, wherein the microcontroller causes one or more combinations of switches to close to determine the combination of fuses to blow.

7. The circuit of claim 6, wherein the microcontroller causes the one or more combinations of switches to close based on a dichotic search algorithm.

8. The circuit of claim 1, wherein the first, second and third switch transistors are PFETs.

9. The circuit of claim 1, wherein the first, second, and third transistors are PFETs.

10. A method of adjusting an output reference voltage, the method comprising:

coupling a current trimmer to a conventional bandgap voltage reference generator, the current trimmer including one or more current mirrors;

applying a first configuration of the current mirrors in the current trimmer;

measuring a first reference voltage produced by the conventional bandgap reference voltage generator;

applying a second configuration of current mirrors to in the current trimmer;

measuring a second reference voltage produced by the conventional bandgap reference voltage generator;

determining whether the first reference voltage or the second reference voltage is closer to a desired reference voltage; and applying the first configuration when the first reference voltage is closer to the desired reference voltage or applying the second configuration when the second reference voltage is closer to the desired reference voltage, wherein applying include blowing one or more fuses included in the current trimmer and wherein applying includes blowing a first set of set fuses when the first configuration is applied and blowing a second set of fuses when second configuration is applied.

11. The method of claim 10, wherein the first configuration includes a normally closed switch in the closed position.

12. The method of claim 10, wherein the second configuration includes a normally closed switch in an open position.

13. The method of claim 12, wherein the second configuration includes a normally open switch in the closed position.

* * * * *